US006168043B1

(12) United States Patent
Yen et al.

(10) Patent No.: US 6,168,043 B1
(45) Date of Patent: Jan. 2, 2001

(54) ICE SEPARATION DEVICE

(76) Inventors: Wen-Li Yen; Chi-Bin Cheng, both of 58, Ma Yuan West St., Taichung (TW)

( * ) Notice: Under 35 U.S.C. 154(b), the term of this patent shall be extended for 0 days.

(21) Appl. No.: 09/298,208

(22) Filed: Apr. 23, 1999

(51) Int. Cl.[7] ..... A47G 19/22
(52) U.S. Cl. ..... 220/719; 220/501
(58) Field of Search ..... 220/719, 716, 220/718, 703, 704, 501, 734; 210/162

(56) References Cited

U.S. PATENT DOCUMENTS 4,305,416 * 12/1981 Henning et al. ..... 137/38
4,938,375 * 7/1990 Fantacone ..... 220/709
5,370,258 * 12/1994 Fair ..... 220/719
5,857,584 * 1/1999 Taggart ..... 220/719
5,862,937 * 1/1999 Carrizales et al. ..... 220/501
5,868,266 * 2/1999 Nobakht ..... 220/23.86

* cited by examiner

*Primary Examiner*—Stephen Castellano
(74) *Attorney, Agent, or Firm*—Alan D. Kamrath; Oppenheimer Wolff & Donnelly LLP

(57) ABSTRACT

An ice separation device has an ice container and an annular grid device inserted in the ice container. The ice container has an inner bottom flange. The annular grid device has a hollow interior, a plurality of longitudinal bars, a plurality of T-shaped lateral plates, and a plurality of spaced slots. Each T-shaped lateral plate has a blocking head. The inner bottom flange of the ice container is inserted in the hollow interior of the annular grid device.

2 Claims, 5 Drawing Sheets

ICE SEPARATION DEVICE

BACKGROUND OF THE INVENTION

The present invention relates to an ice separation device. More particularly, the present invention relates to an ice separation device which can separate a winebottle from ice cubes.

Referring to FIGS. 4 and 5, an ice container 10 contains ice cubes 20. A winebottle 30 is surrounded by the ice cubes 20. In general, the winebottle 30 is placed in the ice container 10 first. Then a plurality of ice cubes 20 are poured into the ice container 10. However, the user should thrust the winebottle 30 into the ice container 10 while the ice container 10 is full of ice cubes 20. When the winebottle 30 is surrounded by the ice cubes 20, it is not easy to pull the winebottle 30 out of the ice cubes 20.

SUMMARY OF THE INVENTION

An object of the present invention is to provide an ice separation device which can receive a winebottle easily.

Another object of the present invention is to provide an ice separation device which can separate a winebottle from ice cubes in an ice container.

Yet another object of the present invention is to provide an ice separation device which has an inner bottom flange of an ice container to protect longitudinal bars of an annular grid device from deforming.

Accordingly, an ice separation device comprises an ice container and an annular grid device inserted in the ice container. The ice container has an inner bottom flange. The annular grid device has a hollow interior, a plurality of longitudinal bars, a plurality of lateral plates, and a plurality of spaced slots defined by the longitudinal bars. The inner bottom flange of the ice container is inserted in the hollow interior of the annular grid device.

DETAILED DESCRIPTION OF THE INVENTION

Figure 1:
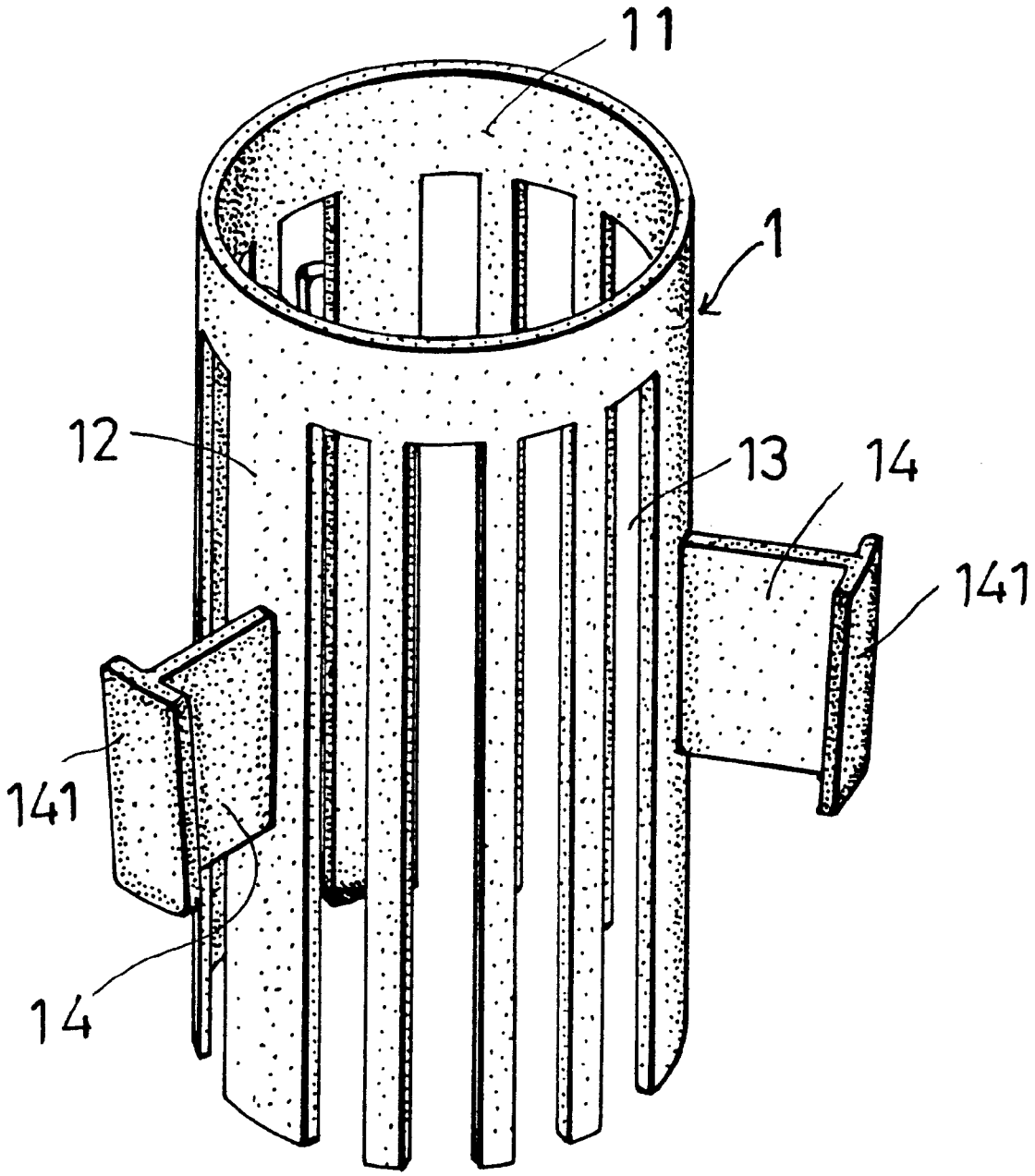
FIG. 1 is a perspective view of an annular grid device of a preferred embodiment in accordance with the present invention.
Figure 2:
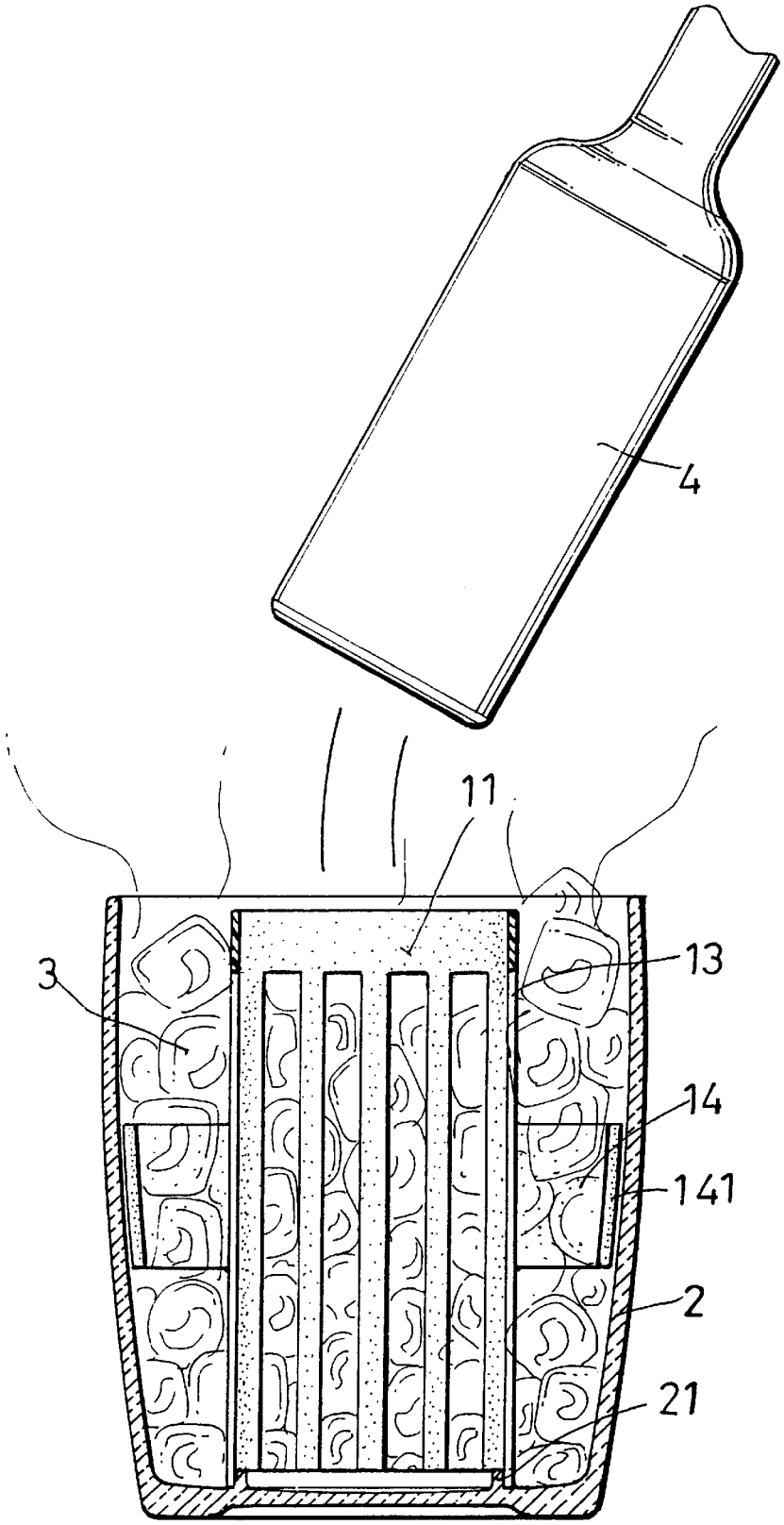
FIG. 2 is a sectional assembly view of an ice separation device of a preferred embodiment in accordance with the present invention.
Figure 3:
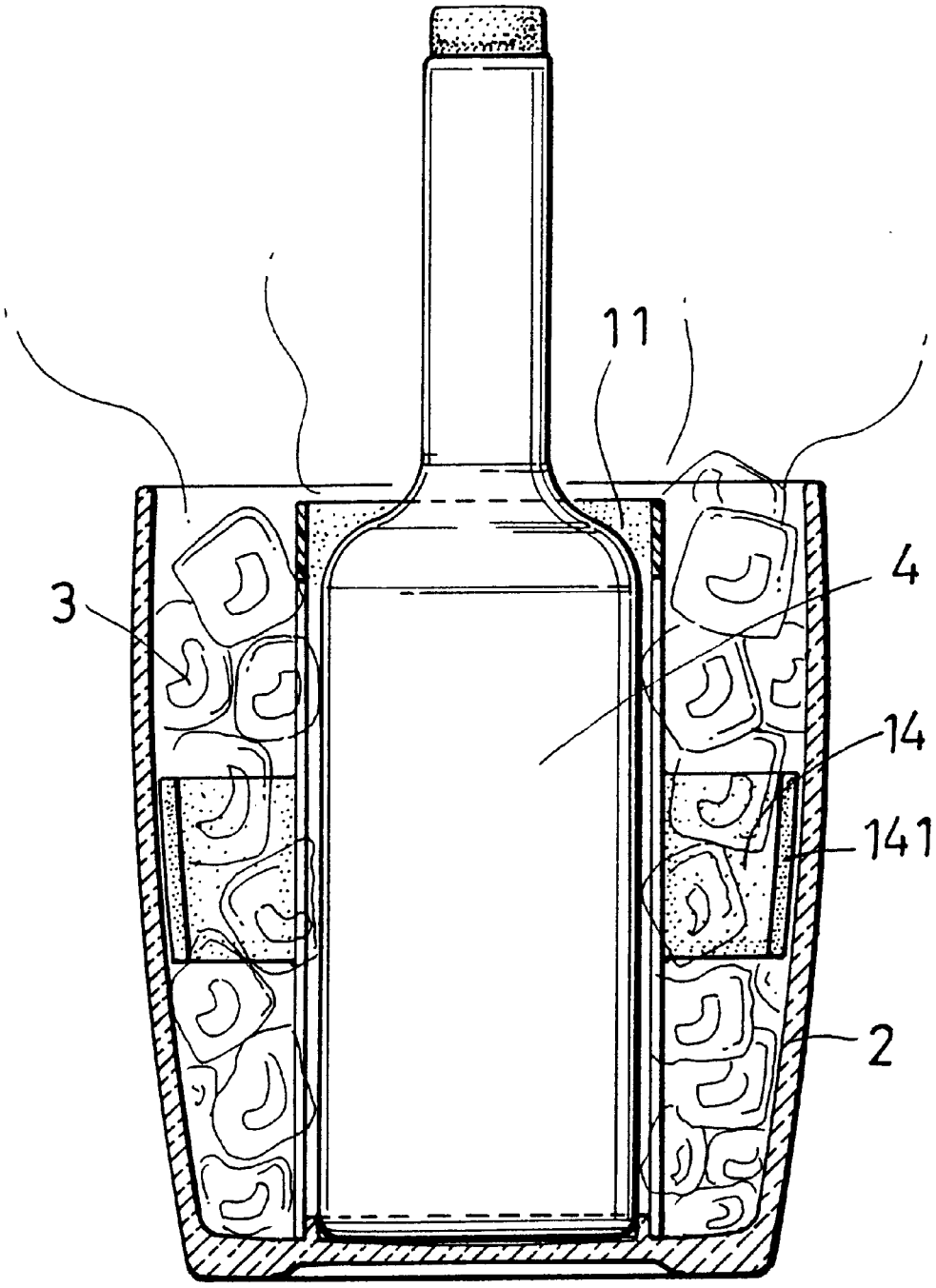
FIG. 3 is a schematic view illustrating a winebottle is inserted in an annular grid device of a preferred embodiment in accordance with the present invention.
Figure 4:
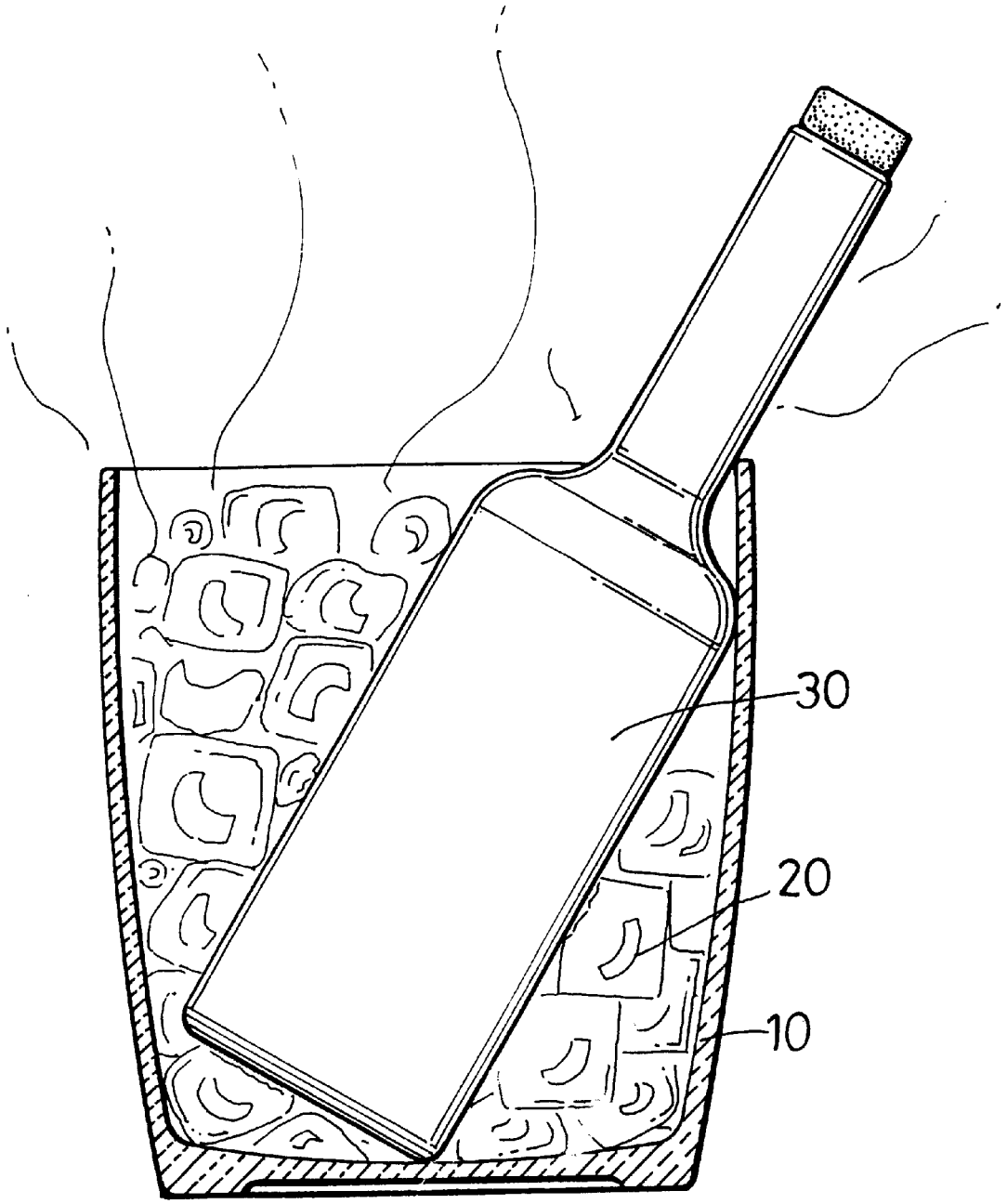
FIG. 4 PRIOR ART
FIG. 4 is a schematic view illustrating a winebottle is placed in an ice container of the prior art.
Figure 5:
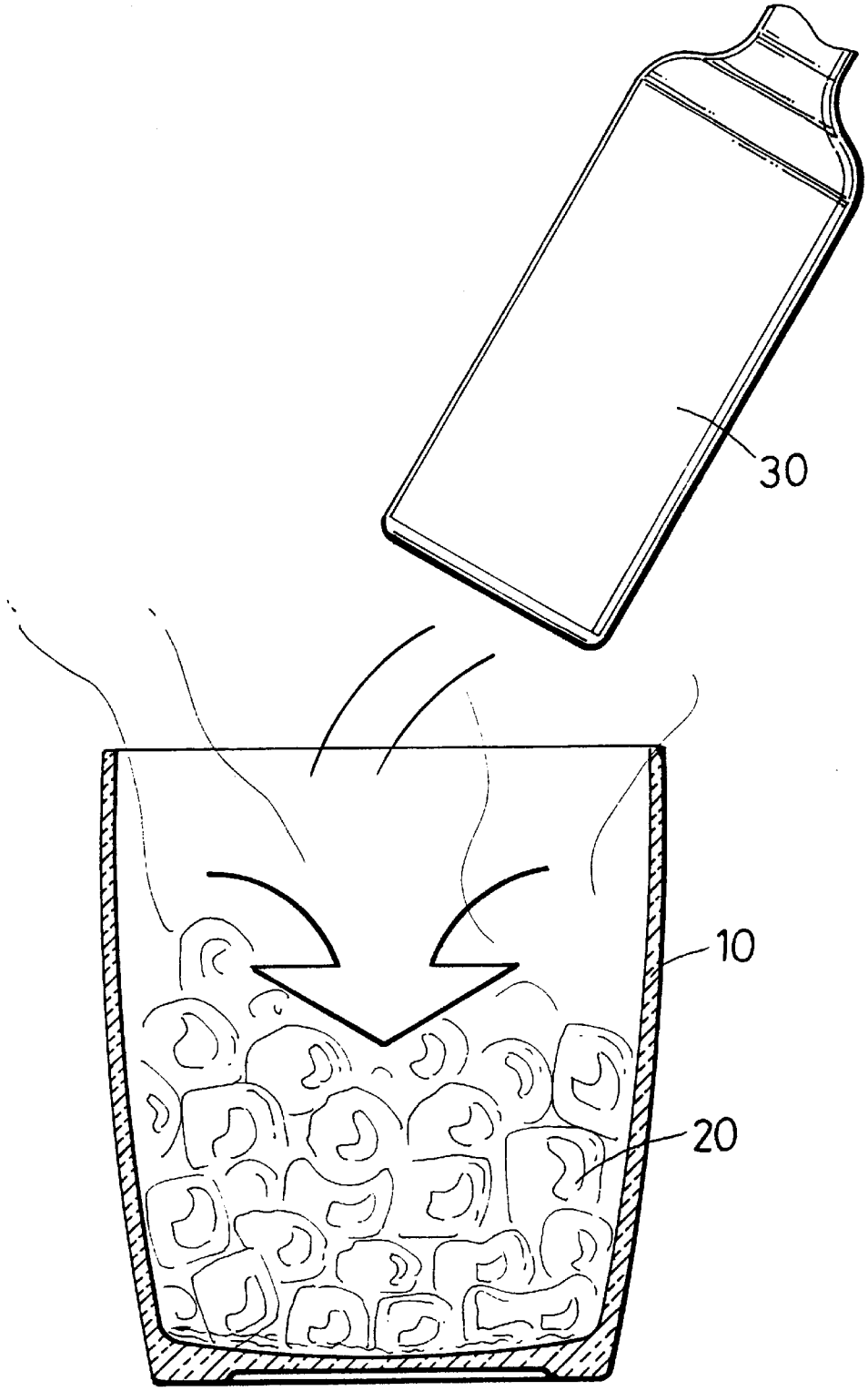
FIG. 5 PRIOR ART
FIG. 5 is a schematic view illustrating a winebottle is inserted in an ice container of the prior art while the ice container is full of ice cubes.

Referring to FIGS. 1 to 3, an ice separation device comprises an ice container 2 and an annular grid device 1 inserted in the ice container 2.

The ice container 2 has an inner bottom flange 21.

The annular grid device 1 has a hollow interior 11, a plurality of longitudinal bars 12, a plurality of T-shaped lateral plates 14, and a plurality of spaced slots 13 defined by the longitudinal bars 12.

Each of the T-shaped lateral plates 14 has a blocking head 141. The blocking head 141 contacts an inner periphery of the ice container 2.

The inner bottom flange 21 of the ice container 2 is inserted in the hollow interior 11 of the annular grid device 1.

A plurality of ice cubes 3 are poured into a spacing between the annular grid device 1 and the ice container 10.

Since the ice cubes 3 squeeze the longitudinal bars 12 toward the inward of the annular grid device 1, the inner bottom flange 21 of the ice container 2 will protect the longitudinal bars 12 from deforming.

Referring to FIG. 2, a winebottle 4 is pulled upward from the annular grid device 1 easily.

Referring to FIG. 3, the winebottle 4 is inserted in the annular grid device 1 easily.

The present invention is not limited to the above embodiment but various modification thereof may be made. Furthermore, various changes in form and detail may be made without departing from the scope of the present invention.

I claim:

1. An ice separation device comprises:

an ice container having an inner bottom flange, an annular grid device inserted in the ice container, the annular grid device having a hollow interior, a plurality of longitudinal bars, a plurality of lateral plates, and a plurality of spaced slots defined by the longitudinal bars, and the inner bottom flange of the ice container inserted in the hollow interior of the annular grid device.

2. The ice separation device as claimed in claim 1, wherein each of the lateral plates has a blocking head.

* * * * *